United States Patent [19]

Houben

[11] 4,209,341

[45] Jun. 24, 1980

[54] CENTRIFUGE FOR SEPARATING MASSECUITE

[75] Inventor: Heinz Houben, Mönchen-Gladbach, Fed. Rep. of Germany

[73] Assignee: Maschinenfabrik Buckau R. Wolf Aktiengesellschaft, Grevenbroich, Fed. Rep. of Germany

[21] Appl. No.: 932,918

[22] Filed: Aug. 11, 1978

[30] Foreign Application Priority Data

Aug. 24, 1977 [DE] Fed. Rep. of Germany ..... 2738110

[51] Int. Cl.[2] ..... C13F 1/06

[52] U.S. Cl. ..... 127/19; 210/380 R

[58] Field of Search ..... 127/19; 210/380 R

[56] References Cited

U.S. PATENT DOCUMENTS

| | | | |
|---|---|---|---|
| 635,770 | 10/1899 | Graner | 127/19 |
| 1,652,680 | 12/1927 | Olsen | 127/19 X |
| 1,970,551 | 8/1934 | Berge | 127/19 X |
| 2,110,778 | 3/1938 | Teatini | 127/19 |
| 2,179,436 | 11/1939 | Smith | 127/19 X |
| 3,730,768 | 5/1973 | Pause | 127/19 |
| 3,993,243 | 11/1976 | Dietzel | 127/19 X |
| 4,072,266 | 2/1978 | Dietzel | 127/19 X |

OTHER PUBLICATIONS

"Principles of Sugar Technology", Pieter Honig, ed., vol. 3, p. 273, Elsevier Publishing Co., New York, 1963.

*Primary Examiner*—Sidney Marantz
*Attorney, Agent, or Firm*—Michael J. Striker

[57] ABSTRACT

A centrifuge for separating massecuite into solid and liquid fractions has a rotatable drum which includes a circumferential wall having a small and uniform thickness, and top and bottom walls. Sieves for separating massecuite into its constituent liquid and solid fractions are located in an inner chamber which is bounded by the walls of the drum. At least two rows of holes are formed in the circumferential walls through which the liquid fraction is discharged whereas the solid fraction retains in the inner chamber. The drum is reinforced in the regions of the top and bottom walls, for instance by means of two ring members which are fitted on the circumferential wall adjacent to the top and bottom walls. On the other hand, it can be reinforced by means of inclination of the top wall and/or the bottom wall to a horizontal plane. It is also possible to provide the reinforcing ring member adjacent to the bottom wall and to incline the top wall of the drum, and vice versa.

23 Claims, 3 Drawing Figures

CENTRIFUGE FOR SEPARATING MASSECUITE

BACKGROUND OF THE INVENTION

The present invention relates to a centrifuge for separating massecuite into solid and liquid fractions. More particularly, the present invention relates to a periodically operating centrifuge for separating massecuite, including a swingably suspended rotatable drum which has a flat bottom, a supporting sieve for fine-meshed sieve arranged on an inner surface of the drum and separating massecuite into its constituent liquid and solid fractions as well as forming an intermediate space for the separated liquid fractions or sirup, and holes formed in a circumferential wall in the regions of a top and bottom wall for discharging the centrifuged liquid fraction.

Intermittently operating centrifuges for separating massecuite of the above-mentioned known type have been proposed in the art. They serve for centrifuging of white sugar and have a rotatable shaft and a drum fixedly connected to the latter which are swingably suspended so as to compensate for imbalance during the operation.

For this purpose a centrifuge has been proposed (German Auslegeschrift No. 1208694) in which the capacity of the drum must be increased with the same rotative moment so that the energy consumption per weight unit will be smaller. In such a centrifuge the circumferential wall of the drum has rows of holes which are formed only in the regions of the top and bottom walls in order to make possible effective throttling of a low viscous sirup molasses up to an intermediate number of revolutions. In such a centrifuge the drum can be lengthened without the danger that the liquid fraction or sirup will be prematurely centrifuged.

Bending moments of the top and bottom walls of the drum cause tangential stresses in the circumferential wall in the regions of the top and bottom walls. The superimposed bending moments in the regions of the drum corners result in considerably high relative stresses which are similar to those in the central region of the circumferential wall. For these reasons it has been proposed to reinforce the circumferential wall of the drum in the regions of the top and bottom walls (German Auslegeschrift No. 1208694, German Offenlegungsschriften Nos. 1482740 and 1532698). The circumferential walls of such drums must be manufactured from a solid material by a turning-off process. Such a method of manufacture not only involves high material consumption, but also requires considerable working expenditures. For instance, a drum for accommodating 1000 kg of massecuite has the circumferential wall whose thickness in the central region is equal to 12mm and in the end regions is equal to 15–18 mm. Such a drum must be manufactured from a sheet material whose thickness is equal to 20 mm.

It has also been proposed (German Pat. No. 815,174) to provide the drum with a plurality of rings which are distributed over the entire circumferential wall and spaced from one another by small distances. In such a construction neither material economy, nor compensation for the stresses of the circumferential wall in the region of the top and bottom walls is attained.

Since a centrifuge is also utilized for centrifuging highly viscous molasses which cannot discharge through the holes located adjacent to the bottom wall during short braking periods of the process, it has been proposed to provide additional holes in the central region of the circumferential wall or to provide holes distributed over the entire circumferential wall (German Pat. No. 1,916,280). Since this requires reinforcing the drum in the central region, it has simultaneously been proposed to form such additional holes of an elliptic shape. However, the elliptic holes are labor consuming and expensive to manufacture.

SUMMARY OF THE INVENTION

Accordingly, it is an object of the present invention to provide a centrifuge for separating massecuite, which avoids the disadvantages of the prior art.

More particularly, it is an object of the present invention to provide a centrifuge for separating massecuite, which is less expensive to manufacture and more durable and productive than the known centrifuges.

In keeping with these objects and with others which will become apparent hereinafter, one feature of the present invention resides, briefly stated, in a centrifuge whose rotatable drum has a top wall, a bottom wall, a circumferential wall which latter has a small and uniform thickness, and means for reinforcing the drum located adjacent the top and bottom walls, respectively. The circumferential wall is unworked from inside and outside thereof. The above-mentioned reinforcing means may be formed by two ring members which are fitted on the circumferential wall in the regions of the top and bottom walls, respectively. The ring members may be pressed or shrunk on the circumferential wall of the drum. Preferably, each of the ring members is spaced from the top wall and the bottom wall, respectively, by a distance which is equal to substantially between 10% and 15% of the inner diameter of the drum. A smaller distance, for instance 10 mm, is suitable for a small thickness of the circumferential wall. In a greater drum a correspondingly thicker circumferential wall is required.

When the drum of the centrifuge is constructed in accordance with the present invention it can be rolled from a thin sheet material and can remain unworked from inside and outside. For instance, a drum for accommodating 1000 kg of massecuite can be rolled from a sheet of an unworked blank material whose thickness is equal to 10 mm. No thickening of the circumferential wall is needed. The ring members can be pressed or shrunk on the circumferential wall without difficulties. Due to the bending moments caused by the ring members only minimum stresses take place on the left and on the right of the ring members. Since the ring members restrain deformation, they simultaneously reduce the bending moments of the top and bottom walls. The holes can be drilled so that minimum stresses are generated in the circumferential wall.

A particularly great advantage of such a construction is that the stresses can be distributed over all regions of the drum substantially uniformly. Thereby the circumferential wall of the drum can be made with a uniform thickness in correspondence with tangential stresses in an undisturbed circumferential region, which thickness can be smaller than that of the known drums. The ring members together with the unworked circumferential wall require such small material expenditures that the drum in accordance with the present invention has considerably smaller weight as compared with that of the known drums. Due to the reduced weight of the drum the capacity of the drum can be increased with the same rotative moment, and therefore the thus-constructed drum has higher resistance and also longer durability. The thus-constructed drum is superior as compared with the known drums which are provided with a plurality of the ring members distributed over the entire circumferential wall and spaced by small distances from one another, inasmuch as it is less material consuming and better compensates for the stresses.

In accordance with another feature of the present invention, when the drum is destined for centrifuging highly viscous molasses and the circumferential wall thereof must be provided with additional holes, such holes are arranged in two rows and an additional such ring member is fitted on the circumferential wall between the additional rows of holes. The additional rows of holes may be spaced from one another by a distance which is smaller than 15% of the inner diameter of the drum or is equal to substantially one-tenth part of the latter. This is true for the centrifuges for separating massecuite having the conventional dimensions. When more than two additional rows of holes and thereby more than one additional ring member are arranged in the central region of the circumferential wall of the drum, the additional ring members may be spaced from one another by a distance which is equal to substantially 20% and 30% of the inner diameter of the drum or equal to one-fifth part of the latter. When the drum of the centrifuge includes the above-mentioned features of the present invention, the ring members provide for compensation of the stresses generated in the drum so that no thickening of the circumferential wall of the drum is required.

In accordance with a further feature of the present invention, a reinforcing ring may be fitted on the circumferential wall in the region of only one side wall of the drum, for instance in the region of the bottom wall. The circumferential wall in the region of the other side wall, such as the top wall of the drum, may be reinforced by means of outwards inclination of the other wall so that the latter becomes conical. The top wall may be inclined to a horizontal plane at an angle which exceeds 10°, preferably is equal to 15%. The reinforcing ring member may be spaced from the bottom wall by a distance which is equal to substantially between 10% and 15% of the inner diameter of the drum.

When the top wall of the drum is so inclined, the drum possesses the same advantages which the drum with the reinforcing ring in the region of the top wall possesses. This reduces the bending moments generated in the circumferential wall. It has been shown that this also results in reduction of the stresses in the circumferential wall, wherefore the latter can be manufactured of a thinner unworked sheet material.

It is also possible that both reinforcing ring members may be omitted when both the top wall and the bottom wall are outwardly inclined to a horizontal plane. The bottom wall may be inclined to a horizontal plane at an angle which is smaller than the angle at which the top wall is inclined to the same, inasmuch as a hub of the drum by which the latter is mounted on a centrifuge shaft performs restraint of the circumferential wall in the region of the bottom wall.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
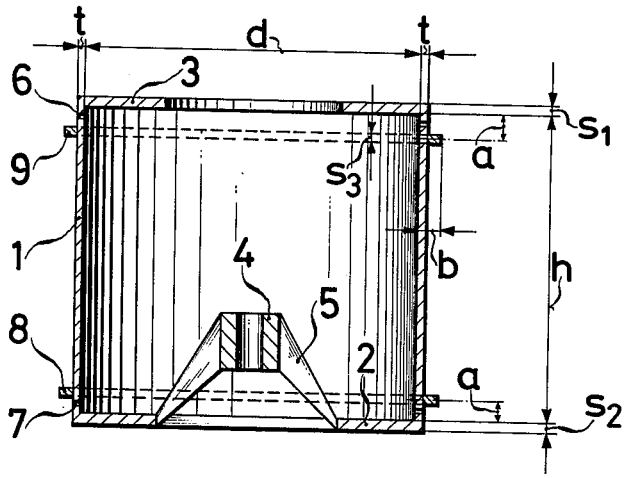
FIG. 1 is a view showing a section of a centrifuge in accordance with the present invention, taken through a drum thereof.

A centrifuge for separating massecuite into a solid and liquid fracture in accordance with the present invention includes a rotatable drum which has a circumferential wall 1, a bottom wall 2 and a top wall 3. The bottom wall 2 and the top wall 3 are connected with the circumferential wall 1 and together bound an inner chamber. A hub 4 is connected with the bottom wall 2 by means of a web 5 and serves for mounting the drum on a rotatable shaft which is known per se and not shown in the drawing. Sieve means is arranged on an inner surface of the drum and may include a supporting sieve and a fine-meshed sieve. The sieve means serves for separating the massecuite into its constituent solid and liquid fractions and bounds an intermediate space for receiving the liquid fraction or sirup. The drum is swingably suspended to a supporting structure.

Rows of holes 6 and 7 are formed in the circumferential wall 1 of the drum adjacent to the top wall 3 and the bottom wall 2 of the latter, respectively. Instead of thickening of the circumferential wall 1 in order to reinforce the same, ring members 8 and 9 are fitted on the circumferential wall 1 in the region of the bottom wall 2 and the top wall 3, respectively. The ring members 8 and 9 are pressed on or shrunk on the circumferential wall 1. The thus-constructed drum with the capacity equal to 1000 kg may be manufactured of sheet material whose outer and inner surfaces are unworked and which has a wall thickness t equal to 10 mm, the inner diameter d equal to 1220 mm and the inner height h equal to 1050 mm. A conventional drum of the same diameter must have the wall thickness in the central region equal to at least 12 mm and the wall thickness in the regions of the top and bottom walls equal to at least from 15 to 18 mm.

Each of the ring members 8 and 9 is spaced from the bottom wall 2 and the top wall 3, respectively, by a distance a which is equal to substantially between 10% and 15% of the inner diameter d of the drum. In the above-described drum the distance a is equal, for instance, to 120 mm. Each of the ring members 8 and 9 is constituted by a flat iron or bar having a thickness $S_3$ and a height b. The ring members 8 and 9 have a cross-section which is defined by the formula:

$$(b \cdot S_3)/(t3/2) = 20\text{–}45$$

Such a drum is utilized for low viscous molasses.

Figure 2:
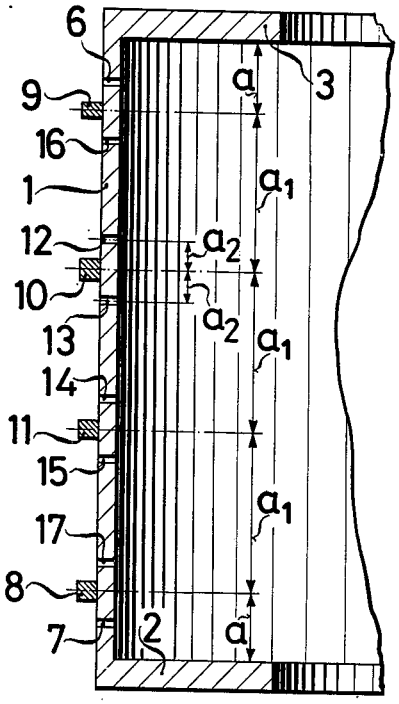
FIG. 2 is a view substantially corresponding to that shown in FIG. 1, but showing another embodiment of the present invention.

FIG. 2 shows a centrifuge in accordance with another embodiment of the present invention, and particularly a centrifuge which is suitable for centrifuging highly viscous molasses. In such a case the drum is provided with one or more additional rows of holes arranged in the central region of the drum. The circumferential wall 1 of the drum is again constituted by an unworked thin material. In order to accommodate 1000 kg of massecuite in this drum, two additional reinforcing ring members 10 and 11 are provided each of which is located between two additional rows of holes 12, 13 and 14, 15. When the ring members 10 and 11 are spaced from the first-mentioned rings 9 and 8 by a distance $a_1$ which is equal to 270 mm, no thickening of the circumferential wall 1 of the drum is required.

Taking into consideration the stresses generated in the drum, the ring members 10 and 11 give a possibility to arrange the rows of holes so that they are spaced by a small distance from one another. When six additional rows of holes are provided, the big drum having the inner height h equal to 1050 mm and the inner diameter d equal to 1220 can be utilized without thickening of the circumferential wall 1. This means that such a drum is suitable for satisfactory centrifuging of the high viscous molasses. Rows of holes 16 and 17 are formed adjacent to the ring members 9 and 8. If needed, two rows of holes may be provided between the top wall 3 and the ring member 9 and between the bottom wall 3 and the ring member 8, respectively.

The additional rows of holes 12, 13 and 14, 15 are spaced from one another by a distance $a_2+a_2$ which is smaller than 15% of the inner diameter d of the drum or is equal to substantially one-tenth part of the latter. The additional ring members 10 and 11 may be spaced from one another and from the first-mentioned ring members 9 and 8 by a distance $a_1$ which is substantially equal to from 20% to 30% of the inner diameter d of the drum, or to one-fifth part of the latter.

Figure 3:
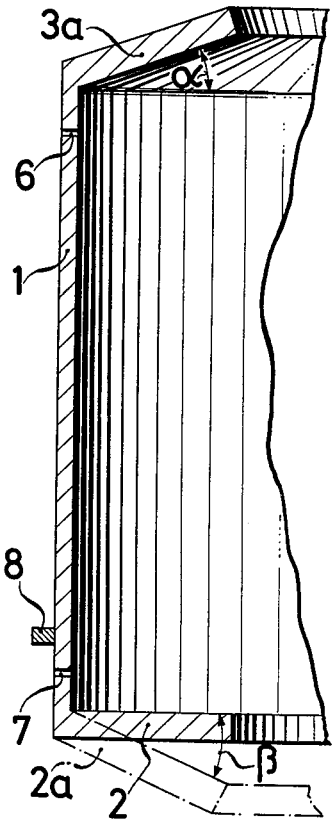
FIG. 3 is a view substantially corresponding to those shown in FIGS. 1 and 2, but showing a further embodiment of the present invention.

FIG. 3 shows a centrifuge in accordance with a further embodiment of the present invention. In the drum of the centrifuge which is shown in this Figure the reinforcing ring member 9 is omitted. In order to compensate for the stresses in the circumferential wall, the top wall 3*a* of the drum in accordance with this embodiment is outwardly conically inclined to a horizontal plane at an angle $\alpha$. In the region of the bottom wall 2 the circumferential wall is again reinforced by the ring member 8. Two rows of holes 6 and 7 are provided in the circumferential wall 1 and arranged adjacent to the top wall 3*a* and the bottom wall 2. The angle $\alpha$ exceeds 10°, and preferably is equal to 15°. The reinforcing ring member 8 is spaced from the bottom wall 2 of the drum by a distance which is equal to substantially from 10% to 15% of the inner diameter d of the drum.

As shown in dotted lines in FIG. 3, the bottom wall 2*a* of the drum may also be outwardly conically inclined to a horizontal plane at an angle $\beta$. In such a construction both ring members 8 and 9 can be omitted. Since the hub 4 connected to the bottom wall of the drum provided for restraint of the drum in the region of this wall, the angle $\beta$ is preferably smaller than or equal to the angle $\alpha$. Preferably, the angle $\beta$ is equal to 5°.

In accordance with the present invention, the top wall 3 or 3*a* has a thickness $S_1$ which 1.5 times exceeds the thickness t of the circumferential wall 1 of the drum. The bottom wall 2 or 2*a* has a thickness $S_2$ which 2 times exceeds the thickness t of the circumferential wall of the drum. On the other hand, the thickness t of the unworked circumferential wall 1 is smaller than one-hundredth part of the inner diameter d of the drum.

It will be understood that each of the elements described above, or two or more together, may also find a useful application in other types of constructions differing from the types described above.

While the invention has been illustrated and described as embodied in a centrifuge for separating massecuite, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A centrifuge for separating massecuite into solid and liquid fractions, comprising a rotatable drum having a circumferential wall, a top wall and a bottom wall together bounding an inner chamber, said circumferential wall being unworked and having a small and uniform thickness, said circumferential wall being subjected in operation to tangential stresses in the regions of said top wall and bottom wall resulting from bending moments generated in the latter; sieve means in said inner chamber and arranged for separating massecuite into its constituent solid and liquid fractions; means for discharging the liquid fraction from said inner chamber and retaining the solid fraction in the latter, including two rows of holes one of which is arranged adjacent to said bottom wall whereas the other row is formed adjacent to said top wall; means for reinforcing said drum cooperating with said circumferential wall but located only adjacent to said top and bottom walls, respectively, so as to reduce said tangential stresses in the regions of said top wall and bottom walls whereby at least a major part of said circumferential wall remains free of said reinforcing means, and the entire circumferential wall remains having said small and uniform thickness, said reinforcing means being two ring members fitted on said circumferential wall of said drum adjacent to said top and bottom walls, respectively, and each spaced from said bottom and top walls, respectively, by a distance which is equal to substantially between 10 and 15% of the inner diameter of said drum; and means for rotating said drum.

2. A centrifuge as defined in claim 1, wherein said ring members are rings which are pressed on said circumferential wall.

3. A centrifuge as defined in claim 11, wherein each of said ring members has a cross-section whose dimensions are defined in accordance with the formula:

$$(b \cdot S_3)/t^{3/2}=20\text{–}45$$

wherein b is a height of each of the rings, $S_3$ is a thickness of each of the rings, and t is a thickness of said circumferential wall of said drum.

4. A centrifuge as defined in claim 1, wherein said circumferential wall has a central region located between said top and bottom walls, said discharging and retaining means further including two additional such rows of holes arranged in said central region of said circumferential wall, said reinforcing means further including an additional such reinforcing ring member fitted on said circumferential wall between said additional rows of holes.

5. A centrifuge as defined in claim 4, wherein said drum has a predetermined inner diameter, said additional rows of holes being spaced from one another by a distance which is smaller than 15% of the inner diameter of said drum.

6. A centrifuge as defined in claim 4, wherein said discharging and retaining means includes two further such rows of holes arranged in said central region of said circumferential wall and spaced from said additional holes, said reinforcing means further including a further such ring member fitted on said circumferential wall between said further rows of holes.

7. A centrifuge as defined in claim 6, wherein said drum has a predetermined inner diameter, said further ring member being spaced from said additional ring member by a distance which is equal to one-fifth part of the inner diameter of said drum.

8. A centrifuge for separating massecuite into solid and liquid fractions, comprising a rotatable drum having a circumferential wall, a top wall and a bottom wall together bounding an inner chamber, said circumferential wall being unworked and having a small and uniform thickness, said circumferential wall being subjected in operation to tangential stresses in the regions of said top wall and bottom wall resulting from bending moments generated in the latter; sieve means in said inner chamber and arranged for separating massecuite into its constituent solid and liquid fractions; means for discharging the liquid fraction from said inner chamber and retaining the solid fraction in the latter, including two rows of holes one of which is arranged adjacent to said bottom wall whereas the other row is formed adjacent to said top wall; rings for reinforcing said drum, fitted on and cooperating with said circumferential wall but located only adjacent to said top and bottom walls, respectively, so as to reduce said tangential stresses in the regions of said top wall and bottom walls whereby at least a major part of said circumferential wall remains free of said reinforcing rings, and the entire circumferential wall remains having said small and uniform thickness; and means for rotating said drum.

9. A centrifuge as defined in claim 8, wherein said drum is swingably suspended to a supporting structure; and further comprising means for swingably suspending said drum, to the supporting structure.

10. A centrifuge as defined in claim 8, wherein said sieve means includes a supporting sieve and a fine-meshed sieve.

11. A centrifuge as defined in claim 8, wherein said circumferential wall has a predetermined thickness, said top wall having a thickness which 1 to 5 times exceeds the thickness of said circumferential wall.

12. A centrifuge as defined in claim 8, wherein said circumferential wall has a predetermined thickness, said bottom wall having a thickness which 2 times exceeds the thickness of said circumferential wall.

13. A centrifuge as defined in claim 8, wherein said drum has a predetermined inner diameter, said circumferential wall having a thickness which is smaller than one-hundredth part of the inner diameter of said drum.

14. A centrifuge for separating massecuite into solid and liquid fractions, comprising a rotatable drum having a circumferential wall, a top end wall and a bottom end wall together bounding an inner chamber, said circumferential wall being unworked and having a small and uniform thickness, said circumferential wall being subjected in operation to tangential stresses in the regions of said top end wall and bottom end wall resulting from bending moments generated in said end walls; sieve means in said inner chamber and arranged for separating massecuite into its constituent solid and liquid fractions; means for discharging the liquid fraction from said inner chamber and retaining the solid fraction in the latter, including two rows of holes one of which is arranged adjacent to said bottom end wall whereas the other row is formed adjacent to said top end wall; means for reinforcing said drum cooperating with said circumferential wall but located only adjacent to said top and bottom end walls, respectively, so as to reduce said tangential stresses in the regions of said top end wall and bottom end walls whereby at least a major part of said circumferential wall remains free of said reinforcing means, and the entire circumferential wall remains having said small and uniform thickness, said reinforcing means including a ring member which is fitted on said circumferential wall adjacent to one of said end walls and reinforces said drum in the region of the latter, the other of said end walls being outwardly inclined so as to form a part of said reinforcing means which reinforces said drum in the region of said other end wall; and means for rotating said drum.

15. A centrifuge as defined in claim 14, wherein said one end wall is formed by said bottom end wall, and said other end wall is formed by said top end wall.

16. A centrifuge as defined in claim 14, wherein said other end wall is conical.

17. A centrifuge as defined in claim 14, wherein said other end wall extends at an angle to a horizontal plane which exceeds 10°.

18. A centrifuge as defined in claim 14, wherein said drum has a predetermined inner diameter, said ring member being spaced from said one end wall by a distance which is equal to substantially between 10% and 15% of the inner diameter of said drum.

19. A centrifuge for separating massecuite into solid and liquid fractions, comprising a rotatable drum having a circumferential wall, a top wall and a bottom wall together bounding an inner chamber, said circumferential wall being unworked and having a small and uniform thickness, said circumferential wall being subjected in operation to tangential stresses in the regions of said top wall and bottom wall resulting from bending moments generated in the latter; sieve means in said inner chamber and arranged for separating massecuite into its constituent solid and liquid fractions; means for discharging the liquid fraction from said inner chamber and retaining the solid fraction in the latter, including two rows of holes one of which is arranged adjacent to said bottom wall whereas the other row is formed adjacent to said top wall; means for reinforcing said drum cooperating with said circumferential wall but located only adjacent to said top and bottom walls, respectively, so as to reduce said tangential stresses in the regions of said top wall and bottom wall whereby at least a major part of said circumferential wall remains free of said reinforcing means, and the entire circumferential wall remains having said small and uniform thickness, said top wall of said drum being outwardly inclined to a horizontal plane at a first angle and said bottom wall of said drum being outwardly inclined to the horizontal plane at a second angle so as to form said reinforcing means; and means for rotating said drum.

20. A centrifuge as defined in claim 19, wherein said top and bottom walls of said drum are conical.

21. A centrifuge as defined in claim 19, wherein said second angle exceeds 5°.

22. A centrifuge as defined in claim 19, wherein said first angle is at least equal to said second angle.

23. A centrifuge as defined in claim 22, wherein said first angle exceeds said second angle.

* * * * *